US005159858A

United States Patent [19]

Gansen

[11] Patent Number: 5,159,858

[45] Date of Patent: Nov. 3, 1992

[54] FRAMING HAMMER CONSTRUCTION

[76] Inventor: Michael J. Gansen, 4934 Sweetwood Dr., El Sobrante, Calif. 94803

[21] Appl. No.: 701,851

[22] Filed: May 17, 1991

[51] Int. Cl.[5] ..... B25D 1/00

[52] U.S. Cl. ..... 81/23; 81/20; 7/143

[58] Field of Search ..... 81/20, 23, 26; 7/143, 7/146

[56] References Cited

U.S. PATENT DOCUMENTS

| | | | |
|---|---|---|---|
| 193,967 | 8/1877 | Knight | 81/23 |
| 638,341 | 12/1899 | Knight | 81/23 |
| 704,006 | 7/1902 | Dempsey | 81/26 |
| 825,560 | 7/1906 | Smith | 81/23 |
| 1,411,567 | 4/1922 | Fisher | 7/146 |
| 2,227,455 | 1/1941 | Lane | 81/23 |
| 2,542,603 | 2/1951 | Watters et al. | 81/23 |
| 2,599,651 | 6/1952 | McClung | 81/23 |
| 2,652,082 | 9/1953 | Zanelli | 81/23 |
| 2,722,251 | 11/1955 | Dillon | 81/23 |
| 4,798,107 | 1/1989 | Furey | 81/23 |
| 4,843,925 | 7/1989 | Furey | 81/23 |

*Primary Examiner*—Frank T. Yost
*Assistant Examiner*—Hwei-Siu Payer
*Attorney, Agent, or Firm*—Schapp and Hatch

[57] ABSTRACT

A framing hammer construction in which a conventional hammer head is provided with a boss permanently secured to one side of the hammer head, this boss containing double tapered grooves for releasably holding laterally projecting nails, together with a flattened boss on the side of the hammer head opposite to the grooved boss for driving nails with sideways blows of the hammer head.

1 Claim, 1 Drawing Sheet

FRAMING HAMMER CONSTRUCTION

BACKGROUND OF THE INVENTION

1. Field of the Invention

This invention relates to a framing hammer for use by carpenters, and more particularly to devices for holding nails to the hammer head while they are being started for driving into place in relatively inaccessible locations.

2. Description of the Prior Art

Framing hammers have heretofore been provided with tapered slots into which the head of the nail can be fitted with the nail protruding laterally from the hammer head so the nail can be started into the wood with the hammer held in one hand.

The previously known hammers of this type fall into two categories. In the first group, the nail holding grooves are incorporated into a specially formed hammer head. This is expensive and impractical be cause framing hammer heads are usually drop forged and the tapered slots can be provided only by expensive machining, if at all. Typical of this first category are the hammers disclosed in U.S. Pat. No. 2,227,455, issued to John Thorne Lane; U.S. Pat. No. 1,411,567, issued Apr. 4, 1922 to C. H. Fisher ; and U.S. Pat. No. 825,560, issued Jul. 10, 1906 to James H. Smith.

The second category of prior patents removably attaches a separate clip to the hammer head to provide the tapered grooves. These devices are not satisfactory because they are too weak to withstand the repeated pounding of the hammer and are likely to come loose and be lost Typical of this second category of prior hammers are those found in U.S. Pat. No. 4,798,107, issued Jan. 17, 1989 to Thomas Furey; U.S. Pat. No. 2,722,251, issued Nov. 1, 1955 to S. S Dillon ; U.S. Pat. No. 2,652,0S2, issued Sep. 15, 1953 to Albert P. Zanelli; U.S. Pat. No. 2,599,651, issued Jun. 10, 1952 to Louis A. McClung; U.S. Pat. No. 2,542,603, issued Feb. 20, 1951 to Lloyd R. Watters et al.

The above-listed patents are believed to be relevant to the present invention because they were adduced by a prior art search made by an independent searcher, and a copy of each of the above-listed patents is supplied to the patent and Trademark Office herewith.

SUMMARY OF THE INVENTION

The framing hammer construction of the present invention utilizes a conventional framing hammer head having a forwardly extending hammering face and rearwardly extending nail pulling claws, the hammer head being formed with a handle receiving socket between the hammering face and the claws, a handle mounted in the socket and extending laterally from the hammering face and claws, and a boss permanently secured to and protruding from a side of said head in overlying relation to said socket and formed with a double tapered groove adapted for receiving the head of a nail and holding said nail firmly for driving partially into a workpiece by sideways movement of the hammer head.

A second, flattened boss is permanently secured to the hammer head on the side thereof opposite to the first named boss, the second boss providing a second hammering face for driving nails with sideways hammer blows . The bosses can be formed separately and then permanently secured in place on their respective sides of the hammer heads Alternatively, the bosses may be formed integrally with the hammer head, if desired.

A first double tapered groove and a second double tapered groove are formed in the first named boss, with the first groove opening toward the hammering face and the second groove opening toward the claws.

It is therefore a principal object of the present invention to provide a framing hammer construction having a boss permanently secured to the hammer head and formed with tapered slot means for holding a nail with the point projecting laterally from the side of the hammer head whereby such nail can be driven partially into wood by a sideways movement of the hammer head.

Another object of the present invention is to provide a hammer head construction of the character described in which the tapered slots are formed in a boss permanently secured to and projecting laterally from the side of the hammer head.

A further object of the present invention is to provide a hammer head construction of the character described having a second, flattened boss on the side of the hammer head opposite to the first named boss for driving nails with sideways movement of the hammer.

Other objects and features of advantage will become apparent as the specification progresses and from the claims.

Figure 1:
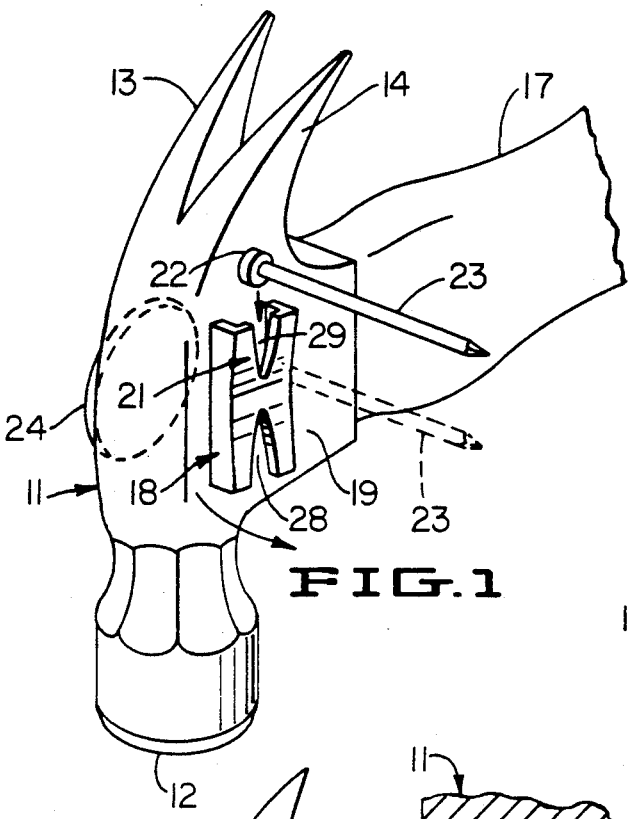
FIG. 1 is a perspective view of a framing hammer construction made in accordance with the present invention and illustrating the positioning of a nail head in a retaining slot, a portion of the handle of the hammer being broken away to conserve space.
Figure 2:
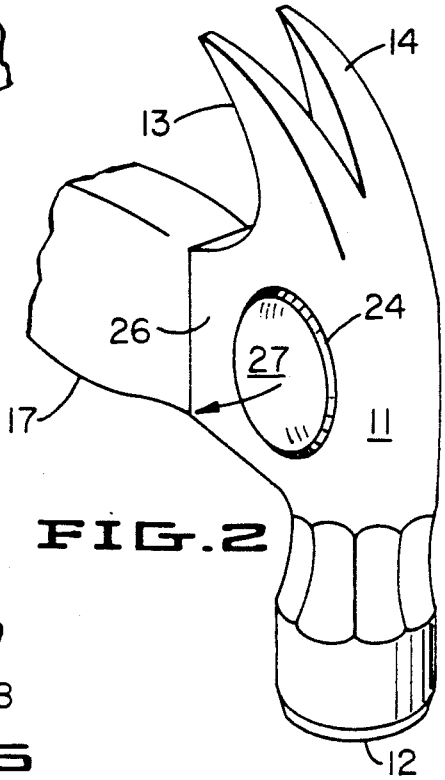
FIG. 2 is a perspective view similar to that of FIG. 1, but taken from the opposite side of the hammer head.
Figure 5:
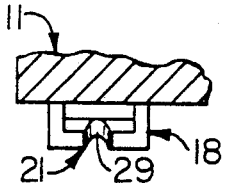
FIG. 5 is a fragmentary cross-sectional view taken on the plane of Line 5—5 of FIG. 3.
Figure 3:
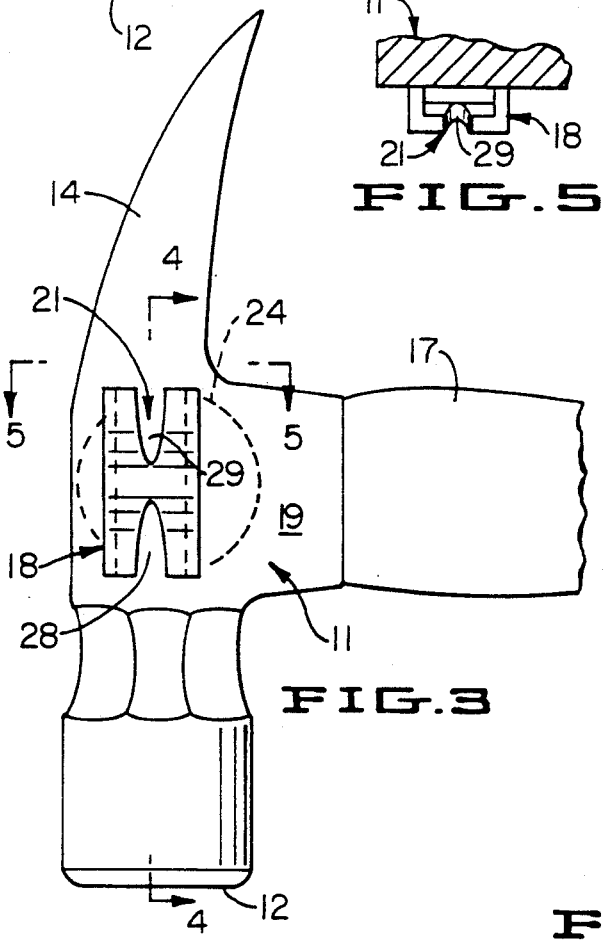
FIG. 3 is a side elevational view of the hammer head of FIG. 1.
Figure 4:
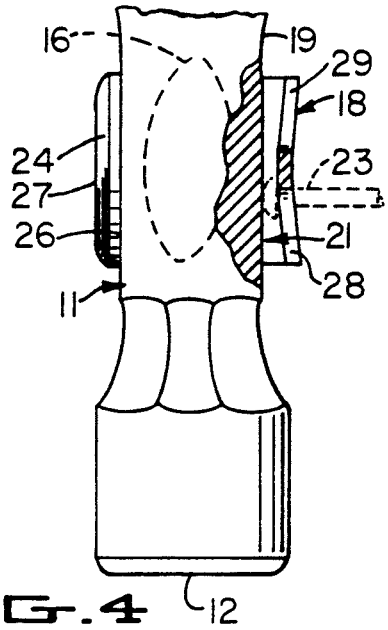
FIG. 4 is a vertical cross-sectional view taken substantially on the plane of Line 4—4 of FIG. 3.

While only the preferred form of the invention is illustrated in the drawings, it will be apparent that various modifications could be made without departing from the ambit of the claims.

DESCRIPTION OF THE PREFERRED EMBODIMENT

The framing hammer construction of the present invention utilizes a conventional framing hammer head 11 having a forwardly extending hammering face 12 and rearwardly extending curved claws 13 and 14 for pulling nails, the hammer head 11 being formed with a handle receiving socket 16 between the hammering face 12 and the claws 13 and 14, a handle 17 being mounted in the socket 16 to extend laterally from the hammer head 11 between the hammering face 12 and the claws 13 and 14.

A boss 18 is permanently secured to and protrudes from one side 19 of the hammer head 11 in overlying relation to the socket 16, the boss 18 being formed with a double tapered groove 21 adapted for receiving the head 22 of a nail 23, and for holding the nail 23 firmly for driving partially into a workpiece (not shown) by sideways movement of the hammer head 11.

Preferably, and as here shown, a second, flattened boss 24 is permanently secured to the hammer head 11 on the side 26 opposite to the side 19 from which the nail holding boss 18 projects. The boss 24 is formed to provide a second hammering face 27 for driving nails with sideways blows of the hammer head.

Preferably, in order to reduce or eliminate machining, the bosses 18 and 24 are formed separately from the hammer head 11 and are permanently secured in place thereon as by welding or braising. Alternatively, the bosses 18 and 24 may be for integrally with the hammer heads and the double tapered grooves 21 machined out.

As here shown, a pair of the double tapered grooves 21 are formed in the boss 18, with one of the grooves 28 opening toward the hammering face 12 and a second groove 29 opening toward the claws 13 and 14

From the foregoing, it will be apparent that the hammer construction of the present invention provides a framing hammer having all of the advantages of double tapered slots for holding different size nails in place so that the nail projects laterally from the hammer head in such manner that sideways movement of the hammer head can start the nail into the wood, the hammer head being of unitary construction with the grooves boss and the lateral hammering boss permanently secured to the hammer head to provide a simple and sturdy construction.

What is claimed is:

1. A framing hammer, comprising a conventional framing hammer head having a forwardly extending hammering face and rearwardly extending curved claws for pulling nails, said hammer head formed with a handle receiving socket between said hammering face and said claws, a handle mounted in said socket to extend laterally from said hammering face and said claws, a boss formed integrally with said hammer head and protruding from a side of said head in overlying relation to said socket, said boss being formed with said first and second tapered undercut grooves, with said first groove opening toward said hammer face and said second groove opening toward said claws.

* * * * *